United States Patent [19]

Norris

[11] 4,162,073

[45] Jul. 24, 1979

[54] HOLLOW PYRAMID CONTAINING INDICIA-BEARING SPHERES

[76] Inventor: Patrick H. Norris, 11470 Soforenko Dr., Jacksonville, Fla. 32218

[21] Appl. No.: 815,933

[22] Filed: Jul. 15, 1977

[51] Int. Cl.[2] ..... A63F 3/00

[52] U.S. Cl. ..... 273/144 B; 273/256

[58] Field of Search ..... 273/144, 145 C, 146, 273/115

[56] References Cited

U.S. PATENT DOCUMENTS

| | | | |
|---|---|---|---|
| 1,506,715 | 8/1924 | Ordway | 273/144 B |
| 2,216,526 | 10/1940 | Watson | 273/144 B |
| 2,752,725 | 7/1956 | Unsworth | 273/144 B X |
| 3,166,323 | 1/1965 | Anderson | 273/144 B X |
| 3,589,728 | 6/1971 | McFarland | 273/144 B X |
| 3,801,104 | 4/1974 | Potts et al. | 273/243 X |

FOREIGN PATENT DOCUMENTS

| | | | |
|---|---|---|---|
| 904979 | 3/1945 | France | 273/144 R |

*Primary Examiner*—Richard C. Pinkham
*Assistant Examiner*—R. Carl Moy
*Attorney, Agent, or Firm*—George H. Baldwin; Arthur G. Yeager

[57] ABSTRACT

An entertainment game device having a game board with a continuous path enclosing a central area within which is disposed a pyramidal random choice device for indicating individual player moves, the continuous path comprising a plurality of player position spaces, with a number of the spaces having indicia thereon relating to a coinage metal and having indicia inwardly adjacent thereto relating to a compass direction; a plurality of sets of owner temples, each of which sets is a distinct color; a plurality of temple color cards; a plurality of monetary reward indicators; a plurality of player objects; and a random choice device for determining individual player moves along the continuous path. The random choice device may comprise a partially hollow tetragonal pyramid having a square base, at least three or four basal corners being transparent; a plurality of spheres, each sphere having individual indicia thereon, enclosed within the tetragonal pyramid; and a surface member for directing the spheres toward the basal corners of the tetragonal pyramid when the pyramid is at rest upon its square base.

10 Claims, 5 Drawing Figures

HOLLOW PYRAMID CONTAINING INDICIA-BEARING SPHERES

BACKGROUND OF THE INVENTION

This invention relates to entertainment game devices in general and particularly to board-type entertainment game devices.

Many board games are known, which are utilized for amusement and/or educational enrichment of the player. Exemplary of such games are those described in U.S. Pat. No. 4,010,955; U.S. Pat. No. 4,010,957; U.S. Pat. No. 4,012,045; U.S. Pat. No. 4,012,046; and references cited therein. Despite the multitude of such games, none of these presently existing board games is known to utilize the mystical powers which allegedly reside in pyramids.

It is therefore an object of this invention to provide an amusement game device which utilizes such alleged inherent pyramid powers.

It is a further object of this invention to provide a random choice means for use in conjunction with a game board which brings such inherent pyramid powers to bear upon the random choice operation of the game.

SUMMARY

An entertainment game device has now been devised which utilizes the alleged mystical powers of the pyramid to dictate the outcome of the game. The game includes a game board having a continuous path of player position spaces which path encloses a central area wherein a pyramidal random choice device is disposed. A number of the player position spaces are individually associated with individual coinage metal indicia as well as compass direction indicia, with the remaining player position spaces having other game related indicia associated therewith. The amusement game device also includes a plurality of sets of ownership temples and a plurality of ownership temple color cards with the color on each card corresponding to the color of one of the sets of owner temples. In addition, the device includes a plurality of player objects, a plurality of monetary reward indicators and a pyramidal random choice means.

A pyramidal random choice means suitable for use in conjunction with the amusement game device may be fabricated from a partially hollow pyramid or truncated pyramid which encloses a plurality of loose spheres having indicia thereon. The pyramidal means is constructed such that one or more of the spheres will be randomly displayed in order to impart game-directing information to the players.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawing(s) in which:

DESCRIPTION OF THE PREFERRED EMBODIMENT

Figure 1:
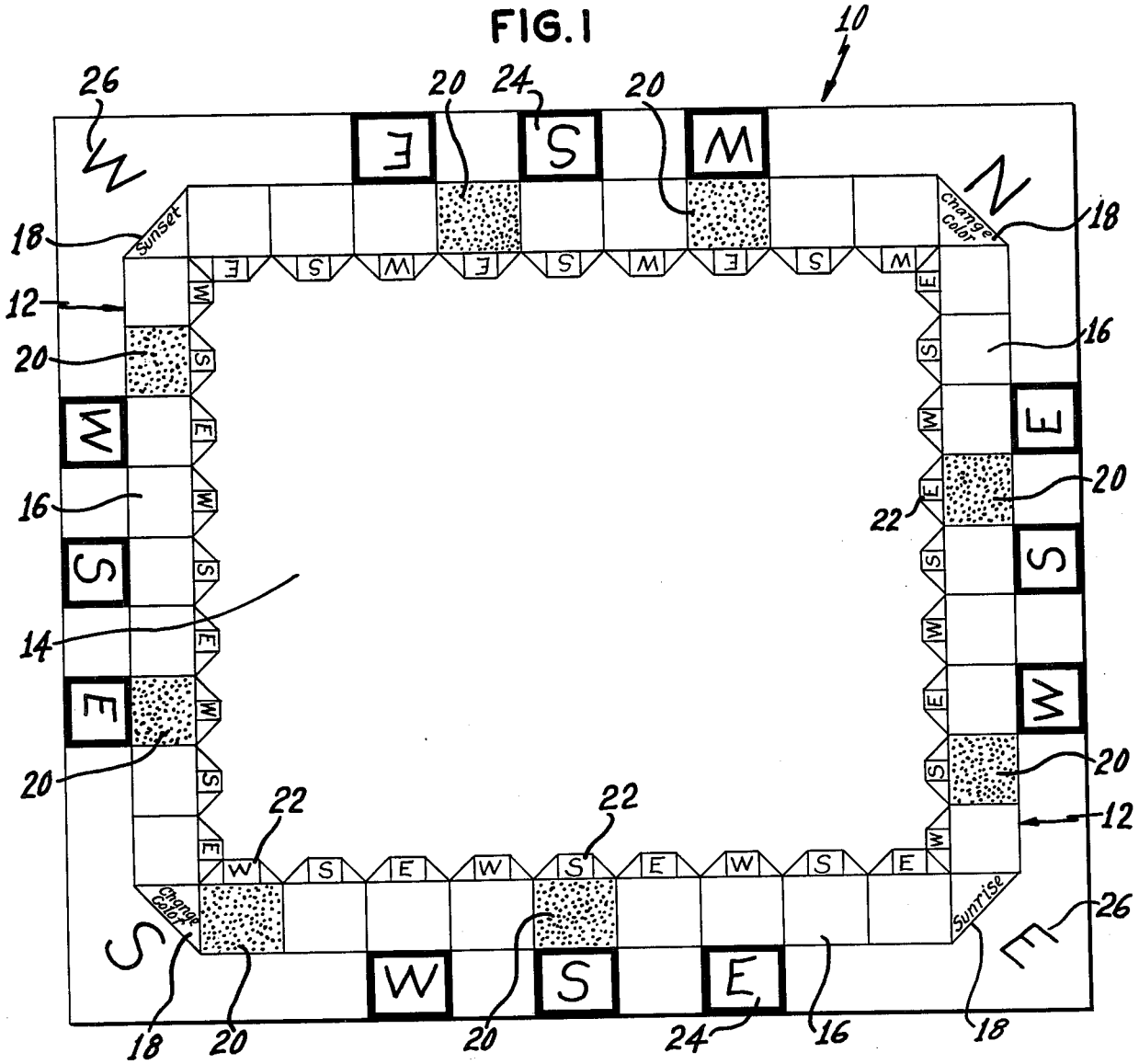
FIG. 1 is a plan view of a game board of the present invention.

Referring to FIG. 1, there is seen a game board 10 having a continuous path 12 enclosing a central area 14. Path 12 has forty individual player position spaces, grouped into four rows of 9, lateral player position spaces 16 and four corner player position spaces 18. Each row of lateral player position spaces has two individual spaces 20 therein, each having color indicia thereon indicating the coinage metal gold, with the remaining seven lateral spaces in each row having color indicia thereon indicating the coinage metal silver. In addition, each lateral space has associated therewith a first individual compass direction selected from the group consisting of west, south and east as shown at 22. As is seen in FIG. 1, the first individual compass directions are arranged such that the first, fourth and seventh lateral player position spaces are associated with west, the second, fifth and eighth spaces are associated with south, and the third, sixth and ninth spaces are associated with east. In addition to the aforesaid first compass directions, a series of temple position spaces 24, each having a second individual compass direction associated therewith, is positioned outwardly adjacent the third, fifth and seventh lateral player position spaces of each row. As is seen, the individual temple position spaces adjacent the third, fifth and seventh lateral player position spaces have compass indicia thereon indicating west, south and east respectively.

Finally, each of the four corner player position spaces 18 has game related indicia thereon and third individual compass direction indicia 26 associated therewith, outwardly adjacent thereto. These game related and third individual compass direction indicia, as shown in FIG. 1 are, respectively, "Sunrise"—east, "Change Temple Color"—south, "Sunset"—west, and "Change Temple Color"—north.

Figure 2:
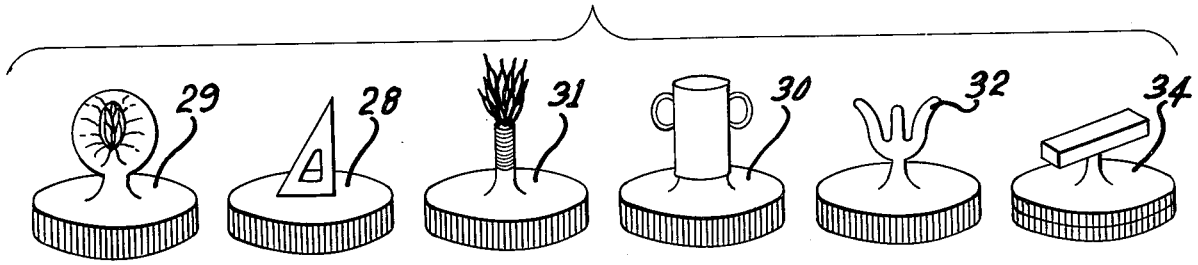
FIG. 2 is a perspective view of various player objects.

In addition to the game board 10, shown in FIG. 1 the amusement game device of this invention includes a plurality of player objects, preferably of the type shown in FIG. 2 which represent objects of antiquity relating generally to articles found in ancient Egypt. These include representations of a sundial 28, a sunburst 29, an urn 30, a torch 31, a symbol 32 and a burial case 34.

Figure 3:
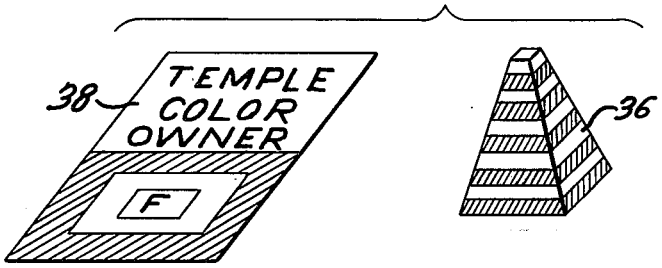
FIG. 3 is a perspective view of an ownership temple and a Temple Color Owner card.
Figure 4:
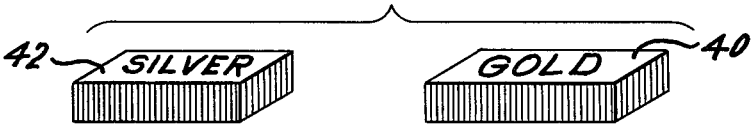
FIG. 4 is a perspective view of various monetary reward indicators.

Also included in the amusement game device paraphernalia, as shown in FIG. 3, are a plurality of sets of owner temples 36, each set having a distinctive color, and a plurality of owner temple color cards 38, each of the cards having a single color thereon substantially the same as a color of one of the plurality of sets of owner temples. In addition, as shown in FIG. 4, a plurality of monetary reward indicators, preferably individual bar-like pieces having indicia thereon indentifying the individual bars as gold 40 or silver 42 are included.

Figure 5:
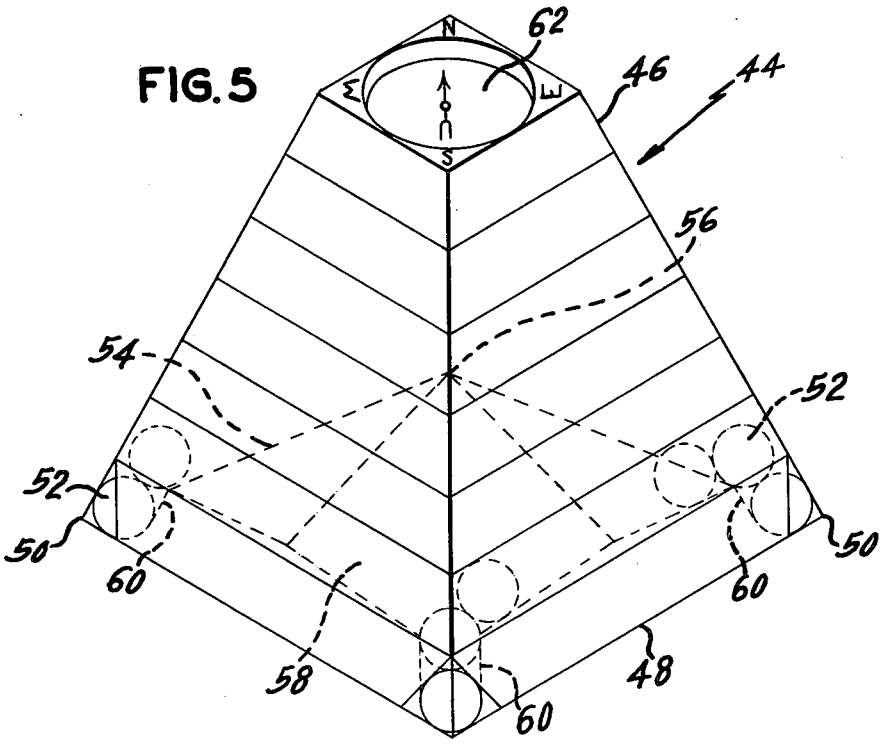
FIG. 5 is a perspective view of a pyramidal random choice means.

Finally, the amusement game device of this invention includes a pyramidal random choice means 44, the preferred embodiment of which is shown in FIG. 5. As seen in FIG. 5, the means 44 comprises a partially hollow enclosure having the shape of a truncated tetragonal pyramid with an upper region 46, a square base 48 and four basal corners 50. Means 44 is fabricated almost entirely from an optically opaque material, preferably of a synthetic plastic, with the exception that three, of its four basal corners are fabricated from optically transparent material. A plurality of spheres 52, each said sphere having individual color indicia thereon, are enclosed within the random choice means. The spheres 52 are individually free to move about the interior of the random choice means and are sized such that only one such sphere may appear in each of the transparent basal corners at any one time. Also included within the random choice means is a means for directing the plurality of spheres 52 toward the individual basal corners 50. This may comprise a pyramidal, base-mounted extension 54 which has an apex 56, disposed vertically beneath the upper region 46 of the means 44, and a plurality of sides 58 downwardly inclined toward the individual basal corners 50. While the means for directing may be fabricated as described, any geometrical shape, such as a spherical section or an undulating surface which will direct the movement of the spheres toward the basal corners will suffice. The means for directing is preferably equipped with individual indentations 60 immediately adjacent the transparent basal corners, which indentations are sized, shaped and positioned so as to restrict the movement of the spheres adjacent the transparent basal corners.

In the preferred embodiment shown in FIG. 5, the random choice means carries a functioning compass 62 recessed in the horizontal surface of its truncated upper region 46 such that the four points of the compass, i.e. north, east, south and west are aligned respectively with the four basal corners of the device. Also the compass is aligned with three transparent basal corners such that they are aligned with the east, south and west points of the compass, with the basal corner aligned with the northerly direction being of optically opaque material in the preferred embodiment.

In order to play the amusement game device of this invention, each player selects a player object from among the individual player objects provided, such as those shown in FIG. 2, and places the object on any of the four corners of game board 10. Each player subsequently selects a Temple owner color card 38 at random from among the plurality of cards, and, on the basis of the temple color indicated thereon, appropriates, for his use during the course of the game, the set of temples 36 having that color, which temples are for use in indicating that player's ownership of individual lateral player position spaces 16.

After each player has selected his individual temple owner color card, each player, in turn, selects three different temples of any desired color and semi-permanently places one of these temples in each of the three temple position spaces 24 outwardly adjacent the third, fifth and seventh lateral player position spaces along the side of the game board closest to the player. The color of each temple and the compass direction associated with the space 24 in which the temple is placed, is used to represent that player's power as described further hereinbelow. Finally, the game board 10 is rotated such that the four corner spaces 18 are oriented in the direction of the magnetic compass directions associated therewith.

Once the preliminary steps described above are completed, the game is commenced by sequentially moving the player objects in a clockwise fashion about the continuous path 12 of game board 10. Individual player moves are dictated by the use of random choice means 44 as described hereinbelow.

One of the players lifts the pyramidal random choice means 44 and inverts it such that the spheres 52 are collected in the upper region 46 of the truncated pyramid. The player may randomize the spheres by rocking or rotating the means sufficiently to thoroughly mix the individual spheres. Means 44 is righted and replaced by the player in the central area 14 of the game board such that the base 48 rests on the board surface, and simultaneously aligns means 44 such that the optically opaque north basal corner is aligned both with the northerly direction indicated by compass 60 and with the north corner player position space. By so doing, one sphere 52, having distinctive color indicia thereon, is exhibited in each of the three transparent basal corners aligned east, south and west respectively. The player who performed the randomizing function then compares the three colors exhibited in the transparent basal corners with the colors of his three power temples in sapces 24. If one of the colors exhibited by the random choice means matches the color of one of that player's power temples, the player moves his player object one space. If two, or all three, colors exhibited match two or all three of the player's power temple colors, that player moves his player object two or three spaces respectively. In addition to these single space moves, if, in addition to the color match between sphere and power temple, there is also a match between the compass direction of the transparent basal corner and the player's tower position space, the player moves his player object two additional spaces along path 12 for a total move of three spaces.

Once the "randomizing" player has moved his player object the appropriate number of spaces, the next player to his immediate left moves his player an appropriate number of spaces in the clockwise direction in accordance with the above described rules. Each player, in turn, moves his player object in a similar fashion until all players have moved, or, conversely, have been unable to move due to a lack of a color match between the spheres and that player's power temples. After each player has moved or failed to move, the player to the immediate left of the original "randomizing" player inverts the random choice means 44, randomizes the spheres and repositions the means 44 in its original position thereby cuasing three new color indicating spheres to be exhibited at the transparent basal corners of means 44. Once again it is the (new) randomizing player who first moves his player object in accordance with the rules stated above. Similarly, once that player moves, the other players take turns, in their order to that player's left, moving their individual player objects.

Each time an individual player object is moved and comes to rest on one of the lateral player position spaces, that player receives a monetary reward indicator, i.e. a silver "bar" 42 if the lateral player position space has indicia thereon indicating silver, or a gold "bar" 40 if the space has indicia indicating gold 20. In addition, if the first compass direction indicia of the lateral player position space upon which a player's player object lands matches the second compass direction indicia of the player's power temple with which a color match with a sphere caused the player object move, that player is declared the owner of that lateral player position space. The player then places an owner temple, the color of his temple owner color card on, or adjacent to, that lateral player position space, and preferably directly on the first compass direction indicia inwardly adjacent to the space, in order to indicate ownership. From that point on, any other player whose player object lands on that square is required to pay the owner three times the value of that space, i.e. three silver bars 42 or three gold bars 40. Furthermore, any time that the owner-player's player object lands on that square, he receives twice the value of that space from the "bank".

As play continues according to the above rules, each of the player objects will pass the four corner spaces 18. In the event a player object comes to rest on either the "Change Temple Color"—north or "Change Temple Color"—south corner player position spaces, that player may exchange one of his power temples for a different color. In the event that a player's player object comes to rest on either the "Sunrise"—east or the "Sunset"—west corner player position space, that player is given the option of refusing to move his player object from that corner player position space until each of the players, himself included, has randomized the random choice means. If, during the time his player object is resting on the "Sunrise"—east corner player position space, the random choice means exhibits a sphere in its east basal corner which sphere's color matches that of the player's power temple which is positioned on the east temple position space 24, the player collects from the "bank" three gold bars. Alternatively, if the player's player object is on the "Sunset"—west corner player position and the color of the sphere in the west basal corner of means 44 matches that of his power temple on the west temple position space, the player collects three silver bars from the bank.

Play is continued according to the above rules with players being eliminated when they no longer hold any gold or silver bars or own any of the lateral player position spaces, until only one player remains. Any player who no longer holds any gold or silver bars, but who does own one or more player position spaces may auction one or more of his owned player position spaces to the highest bidder among the opposing players or alternatively may sell them to the bank for one bar of the coinage metal indicated thereon. In addition, any two players may agree to exchange owned player position spaces, one for one if the spaces are both silver or both gold or three for one if gold and silver.

It is preferred that the random choice means be at least partially filled with a liquid in order that the randomizing of the spheres is damped such that the means is not damaged by their motion. It is also preferred that there be at least eight sets of temples, each said set having a distinct color selected from among red, blue, white, green, black, yellow, purple and gold. In this preferred embodiment it would also be preferred that there be eight spheres one each of the above colors.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A random choice means comprising:

a. a partially hollow pyramidal enclosure having an upper region and having a base having at least three basal corners, three of said corners being transparent;

b. a plurality of spheres enclosed within said pyramidal enclosure, said spheres sized such that not more than one of said spheres is capable of resting in each of the three said basal corners, each of said spheres having individual indicia thereon;

c. means for directing said spheres toward said basal corners when said pyramidal enclosure is at rest on said base, said means for directing being mounted to said pyramidal enclosure interiorly thereof, so constructed and arranged that inverting said pyramidal enclosure causes said spheres to randomize at a position adjacent said upper region, and that subsequent re-inversion causes one of said spheres to come to rest in each of three said basal corners thereby exhibiting said indicia through said transparent basal corner.

2. The random choice means as set forth in claim 1 wherein said means for directing comprises an undulating surface mounted to said base and extending upwardly from said base to a high point beneath said upper region of said pyramidal enclosure, said undulating surface having a plurality of troughs therein leading from said high point to individual said basal corners.

3. The random choice means as set forth in claim 1 wherein said means for directing comprises a spherical section mounted to said base and having a high point beneath said upper region such that said spheres are directed toward said basal corners.

4. The random choice means as set forth in claim 1 wherein said means for directing comprises a polygonal extension having an apex in alignment with, and beneath, said upper region of said pyramidal enclosure and having sides sloping generally downwardly and outwardly therefrom toward said basal corners such that said spheres descending downwardly and outwardly along one of said sides will be directed toward, and retainingly held in the proximity of said associated basal corner.

5. The random choice means as set forth in claim 4, wherein said sides of said polygonal extension intersect with said pyramidal enclosure along lines of intersection spaced above said base and wherein said each of sides have an indentation therein adapted to accept one of said spheres said indentation in each of said sides arranged immediately adjacent to said basal corner such that a sphere may come to rest in said basal corner.

6. The random choice means as set forth in claim 1 wherein said pyramidal enclosure is tetragonal, having four basal corners and having three of said basal corners transparent.

7. The random choice means as set forth in claim 6 wherein said tetragonal enclosure is a truncated tetragonal pyramid and additionally comprising a magnetic compass recessed in to said truncated upper region.

8. The random choice means as set forth in claim 1 additionally comprising a liquid medium substantially filling said pyramid enclosure, said liquid sealingly enclosed within said pyramidal enclosure and having a viscosity not less than that of air.

9. The random choice means as set forth in claim 1 wherein said indicia on each of said plurality of said spheres is a color distinguishable from the color indicia on each other sphere.

10. The random choice means as set forth in claim 1 wherein said spheres are eight in number and have individual color indicia thereon.

* * * * *